United States Patent [19]

Moos

[11] Patent Number: 4,580,727

[45] Date of Patent: Apr. 8, 1986

[54] ATOMIZER FOR COATING WITH POWDER

[75] Inventor: Kurt Moos, Wil, Switzerland

[73] Assignee: Ransburg-Gema AG, Switzerland

[21] Appl. No.: 498,329

[22] Filed: May 26, 1983

[30] Foreign Application Priority Data

Jun. 3, 1982 [DE] Fed. Rep. of Germany ..... 3220796

[51] Int. Cl.[4] ..... B05B 7/10

[52] U.S. Cl. ..... 239/403; 239/463; 239/706

[58] Field of Search ..... 239/399, 403, 463, 400, 239/404, 706

[56] References Cited

U.S. PATENT DOCUMENTS 1,738,489 12/1929 Williams ..... 239/399 X
3,448,925 6/1969 Cross ..... 239/403 X
3,915,387 10/1975 Caruel et al. ..... 239/400
4,359,192 11/1982 Takahashi et al. .

FOREIGN PATENT DOCUMENTS 3014133 10/1981 Fed. Rep. of Germany ..... 239/404

*Primary Examiner*—Andres Kashnikow
*Assistant Examiner*—Daniel R. Edelbrock
*Attorney, Agent, or Firm*—Ostrolenk, Faber, Gerb & Soffen

[57] ABSTRACT

An atomizer for coating an object with powder includes a spray gun with a central feed passage and an atomizer gas flow passage with an outlet radially outside the feed channel. Both the outlet from the feed channel and the atomizer gas passage outlet are located at a widening atomizer gas outlet. Upstream of the spray gun is a body with a plurality of obliquely inclined, axially extending flow channels in it which impart spiral rotation to the gas-powder mixture entering the feed channel in the spray gun. The housing for the body having the inclined flow channels in it is conically tapered upstream and downstream of that body, and upstream of that body there is an upstream facing conical element for directing flow into the flow channels.

7 Claims, 3 Drawing Figures

ATOMIZER FOR COATING WITH POWDER

BACKGROUND OF THE INVENTION

The present invention relates to an atomizer for coating objects with powder, and particularly to means for producing spiral rotation of the powder being atomized prior to atomizing.

One such device is known from German Patent Application DE-OS No. 30 14 133. It shows means for producing spiral rotation of the particles of the gas-powder mixture, which means include a supplementary gas channel which introduces supplementary gas substantially tangentially into the feed channel of the gas-powder mixture. This causes cyclone-like rotation of the gas-powder mixture, around the central axis of the feed channel which conducts this mixture. That rotation takes place relatively far upstream, for example, in the range between 4 cm and 40 cm, of an atomizer nozzle that is arranged at the end of the feed channel. At this nozzle, spraying of the powder is effected by an atomizing gas, which is introduced substantially tangentially. The atomizer nozzle is an open funnel without baffles, so that atomizing is exclusively caused by the simultaneously action of the atomizer gas and by the diffuser effect of the atomizer nozzle. The cyclone-like flow of the mixture, which is effected relatively far upstream, has the purpose of slowing down the flow of mixture and of displacing the particle concentration of the mixture radially outward where the particles are picked up better by the atomizer air and are atomized in a cloud. At the same time as the flow of the gas-powder mixture in the axial direction of the feed channel is slowed, this assures that no "tongue-like" concentration of particles takes place in the atomized cloud of powder.

SUMMARY OF THE INVENTION

The invention is directed at producing the cyclone-like eddying of the mixture around the axis of the feed channel without need for introduction of an addtional gas flow, since introducing additional gas not only requires an additional amount of energy but also undesirably reduces the concentration of the powder in the gas-powder mixture.

The present invention concerns an atomizer for coating an object with powdered material. The atomizer comprises a spray gun which includes a barrel. There is a feed channel extending axially through the barrel for feeding a gas-powder mixture. The outlet from the feed channel in the barrel has an atomizer nozzle at it. A separate atomizer gas passage in the barrel terminates at a respective atomizer gas outlet that is located for discharging atomizer gas into the atomizer nozzle.

The invention is particularly directed to means communicating into the gas-powder mixture feed channel upstream of the atomizer nozzle for producing a spirally rotating downstream movement of the gas-powder mixture through the feed channel and around its axis, such that the powder will exit from the feed channel outlet in this spiraling manner and be distributed around the atomizer nozzle. The gas exiting from the atomizer gas outlet will draw the powder against the wall of the atomizer nozzle. The means for producing this spiral rotation of the gas-powder mixture in the feed channel is spaced along the feed channel upstream of the atomizer nozzle. The means broadly comprises a plurality of spaced apart guide vanes distributed around the axis of the feed channel. Each guide vane extends partially circumferentially around the feed channel and also extends longitudinally of the feed channel. Along its longitudinal extension, each vane is inclined obliquely to the axis of the feed channel. Between adjacent vanes, individual flow channels are defined, whereby there are a plurality of flow channels around the feed channel. In one embodiment, the flow channels are defined by inclined bores through a body located upstream in the feed channel and the walls between adjacent bores are the vanes. The flow channels are radially outside the feed channel. At the downstream exits from the flow channels into the feed channel, the feed channel tapers conically narrower in a funnel shape to the normal cross-section of the feed channel. Upstream of the flow channels, the feed channel also widens up to the entrance ends of the flow channels. For helping delivery of the gas-powder mixture to the flow channels, there is on the upstream side of the body holding the flow channels a generally conical element pointed upstream. The means for causing the spiral movement of the gas-powder mixture is in a structural unit separate from the barrel of the spray gun.

The invention produces a cyclone-like flow of the gas-powder mixture, having the desired radially outwardly increasing concentration of particles of powder in the mixed stream, but without the danger of powder depositing in the flow path. At the same time, the desired slowing of the flow of powder is obtained so that the atomized powder particles do not strike too rapidly against objects to be coated and thus bounce off again. Furthermore, this avoids a tongue-like concentration of powder in the center of the atomized cloud of powder, without need for baffles or guide surfaces in the flow path of the atomizer nozzle.

Atomizers for coating with powder by atomizer nozzles and without baffle plates are also known for instance, from German Applications DE-OS Nos. 28 52 412; 17 77 284 and 14 27 642. In another known atomizer according to German Application DE-OS No. 18 14 809, atomizing takes place in the atomizer nozzle due to guide vanes arranged directly in front of the atomizer nozzle and introduction of the gas-powder mixture in a cyclone-like manner into the atomizer nozzle. In contrast to this, in the invention, atomizing is effected by atomizer gas, and the guide vanes are located at a substantial distance upstream from the atomizer gas so that atomizing is effected by the atomizer gas, but not by the guide vanes.

One embodiment of the invention will be described below by way of example, with reference to the accompanying drawings.

DESCRIPTION OF A PREFERRED EMBODIMENT

Figure 1:
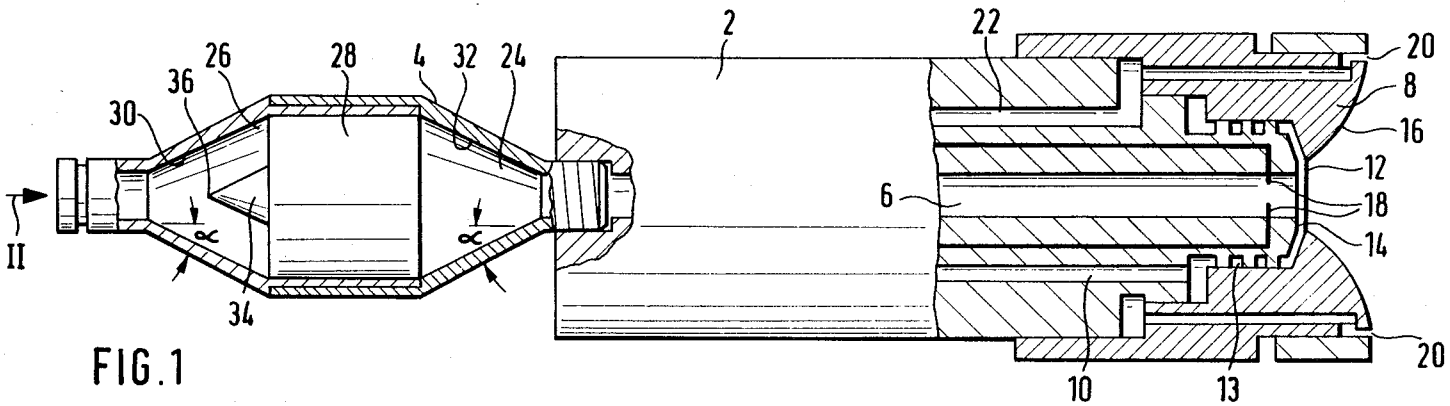
FIG. 1 is a side view, partially in longitudinal section, of an atomizer in accordance with the invention.

The atomizer shown in FIG. 1 is comprised of a structural unit 2 and of a structural unit 4 which is screwed onto the unit 2. The structural unit 2 is referred to as a spray gun. It has a barrel containing a central feed channel 6 for a gas-powder mixture. That channel discharges into an atomizer nozzle 8. The gas-powder mixture results because the powder serving for the coating must be conveyed by a gas. The atomizer nozzle 8 has a funnel-shaped opening with a funnel wall 16 having a cone angle which becomes increasingly larger in the direction of flow. There are no baffle plates or guide surfaces pressent in the atomizer nozzle.

The powder is atomized through introduction of atomizer gas from an atomizer gas channel 10 into the upstream end 12 of the atomizer gas nozzle 8 in the direction toward the funnel-shaped nozzle wall 16, substantially tangentially to that wall, and with such force that the powder from the channel 6 is driven so strongly radially against the funnel wall 16 of the atomizer nozzle 8 that a vacuum is created and a diffuser effect is thereby produced between the powder and the funnel wall. As a result, the jet of powder from channel 6 is torn radially apart and is pulled along the funnel wall 16 of the atomizer nozzle, substantially without reverse eddies. The atomizer gas channel 10 can discharge into the funnel mouth of the atomizer nozzle via a helically extending channel section 13 which is in the form of an annular slit nozzle 14. As an alternative to the helically extending section 13 and the annular slit nozzle 14, individual bore holes can also debouch from the atomizer gas channel 10 into the atomizer nozzle 8.

Directly upstream of the funnel wall 16 of the atomizer nozzle 8, electrodes 18 for electrostatic charging of the powder extend into the feed channel 6.

The atomizer nozzle 8 is coaxially surrounded by an annular slit nozzle 20 to which gas is supplied by a gas channel 22. This surrounds the powder which has been atomized in the form of a cloud in order to impart to the cloud of powder a specific shape and direction of flow.

The other structural unit 4 forms an extension piece 24 of the feed channel 6. The feed channel extension piece 24 is provided with a channel section 26 of widened diameter at its central portion. A guide body 28 is arranged within the channel section 26. The channel section 26 widens at an angle $\alpha$ of about 25° to the longitudianl axis in front of or upstream of the guide body 28 and narrows at the same angle $\alpha$ of 25° back to the normal channel diameter behind or downstream of the guide body 28. The angle of widening and narrowing may lie within the range between 5° and 45° but is preferably 25°. As a result, funnel-shaped channel sections 30 and 32 of the feed channel are produced upstream and downstream, respectively, of the guide body 28. The guide body 28 is provided at its upstream end with a conical extension 34 coaxial with the feed channel and having a cone tip 36 pointing upstream opposite the direction of flow.

Figure 2:
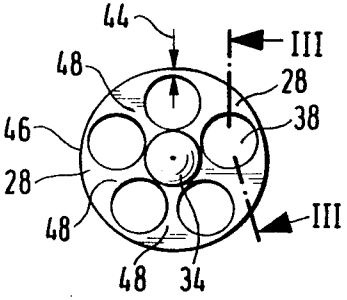
FIG. 2 is an end view of a guide-vane body of FIG. 1, seen in the direction of flow.
Figure 3:
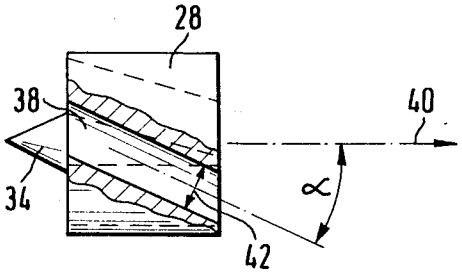
FIG. 3 is a side view of guide-vane body of FIG. 2 with an opening shown in a cross-section extending in the planes III—III of FIG. 2 and parallel to the linear cylinder axis of the cyindrical opening.

FIG. 2 shows the guide body 28 in the direction of the arrow II in FIG. 1. FIG. 3 shows a side view of the guide body 28 with a portion extending obliquely over the outer surface along the planes III—III of FIG. 2. This shows one of several linear bore holes which pass through the guide body 28. By these bore holes, the extension piece 24 of the feed channel 6 is divided into a plurality of individual channels 38. Each individual channel 38 extends linearly and is in a plane with intersects the cylindrical guide body 28 in the manner of a chord. Thus, the individual channels 38 can be produced in simple fashion by drilling them in the extension piece 24. The individual channels 38 extend in a straight line and obliquely to the longitudinal direction 40 of the feed channels 6 and 24, at preferably an angle $\alpha$ of 25° thereto. This angle of the individual channels 38 should lie within the range between 20° and 30°. The individual channels 38 have an inside cross-sectional size which in every dimension is within the range of between 6 mm and 10 mm, and preferably 7 mm. For cylindrical channels, that is their diameter.

The individual channels 38 are distributed uniformly around the conical extension 34 and are located adjacent that extension. The circumferential distance between adjacent individual channels 38 and the thickness of the material 44 between the individual channels 38 and the outer wall 46 of the guide body 28 are very small so that particles of powder will not deposit at these places.

The walls of the individual channels 38 serve as guide vanes for the gas-powder mixture, and they conduct this mixture with an eddy-like twirl into the funnel-shaped channel section 32 of the feed-channel extension piece 24. Thus, the webs 48 located circumferentially between the individual channels 38 form guide vanes, and the walls of the individual channels 38 form the guide-vane walls. From this, it is clear that the individual channels may also be other than cylindrically shaped. The individual channels may also extend radially outward to the outer wall 46 so that the said thickness of material 44 is completely done away with.

The longitudinal distance between the guide body 28 and the funnel wall 16 of the atomizer nozzle 8 is preferably within the range of between 10 cm and 25 cm. The distance should not be less than 2 cm. Otherwise, the desired cyclone-like flow of powder having a larger powder concentration, which becomes increasingly large radially from the inside to the outside, cannot form in the feed channel 6 upstream of the atomizer nozzle 8. The maximum distance between the guide body 28 and the funnel wall 16 should not be greater than 40 cm. Otherwise, the cyclone-like flow of powder in the feed channel 6 would cease being cyclonic. In any event, the guide body 28 must be arranged upstream of the funnel wall 16 of the atomizer nozzle 8 and also upstream of the electrodes 18 for the electrostatic charging of the powder provided in the feed channel 6.

Although the present inventon has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An atomizer for coating an object with powder, comprising:

a spray gun including a barrel; a feed channel extending through the barrel and the channel having an axis; the feed channel being for transmitting a gas-powder mixture; an inlet to the feed channel; an outlet from the feed channel, an atomizer nozzle located at the feed channel outlet;

an atomizer gas passage in the barrel, which terminates at an atomizer gas outlet located for discharging atomizer gas into the atomizer nozzle;

means communicating into the feed channel upstream of the atomizer nozzle for producing a spiral, rotating, downstream movement of the powder of the gas-powder mixture around the axis of the feed channel at the atomizer nozzle; said means comprising:

guide vanes distributed around the axis of the feed channel; each vane extending partially circumferentially around the feed channel, extending longitudinally of the feed channel and being inclined obliquely to the axis of the feed channel at that means;

the said vanes being inclined at an angle in the range between 20°–30° obliquely to the axis of the feed channel;

the said vanes also being spaced apart and shaped to define individual flow channels between adjacent vanes;

the said flow channels have inside cross-sectional dimensions, all of which are in the range of 6mm.–10mm.;

the vanes and the flow channels between them being located spaced radially out from the portion of the feed channel which is downstream of the flow channels;

the means further comprising a generally conical element having a point facing upstream of the feed channel, and the conical element being located at the feed channel and upstream of the flow channels for directing the flow of gas-powder mixture along the conical element to the flow channels;

the feed channel widening in a funnel shape upstream of the flow channels and narrowing in a funnel shape downstream of the flow channels, and both of these funnel shapes have a respective cone angle in the range of 5°–45° to the axis of the feed channel there; and the distance between the downstream side of the flow channels and the atomizer gas outlet at the atomizer nozzle being in the range of 10cm.–25cm.

2. The atomizer of claim 1, wherein the means includes a body in the feed channel, the flow channels are openings formed in the body and are defined by walls of the flow channels which are defined by the body; the walls of the flow channels are the guide vanes.

3. The atomizer of claim 2, wherein the flow channel openings are cylinders with respective linear axes all inclined obliquely to the axis of the feed channel.

4. The atomizer of claim 1, wherein the atomizer nozzle, the atomizer gas channel and the feed channel are together in the spray gun as a first structural unit; the means for producing a spiral rotating downstream movement of the gas-powder mixture, and including in it a part of the feed channel, comprises a second structural unit which is detachably fastened upstream of the first structural unit and at the feed channel.

5. The atomizer of claim 1, wherein the atomizer gas outlet is located radially outside of and around the outlet end of the feed channel at the atomizer nozzle.

6. The atomizer of claim 5, wherein the atomizer nozzle includes an annular funnel wall which widens in the direction of flow, whereby the air exiting from the atomizer gas passage outlet draws the powder exiting from the outlet end of the feed channel against the atomizer nozzle wall.

7. The atomizer of claim 1, further comprising means in the feed channel upstream of the outlet end for electrostatically charging the powder passing through the feed channel.

* * * * *